US012402651B2

(12) United States Patent
Park et al.

(10) Patent No.: US 12,402,651 B2
(45) Date of Patent: Sep. 2, 2025

(54) AEROSOL GENERATING DEVICE AND AEROSOL GENERATING SYSTEM

(71) Applicant: KT&G CORPORATION, Daejeon (KR)

(72) Inventors: In Su Park, Seoul (KR); Sung Jong Ki, Daejeon (KR); Young Joong Kim, Daejeon (KR); John Tae Lee, Daejeon (KR); Sun Hwan Jung, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 320 days.

(21) Appl. No.: 17/280,989

(22) PCT Filed: Dec. 15, 2020

(86) PCT No.: PCT/KR2020/018373
§ 371 (c)(1),
(2) Date: Oct. 6, 2022

(87) PCT Pub. No.: WO2021/177563
PCT Pub. Date: Sep. 10, 2021

(65) Prior Publication Data

US 2023/0077221 A1 Mar. 9, 2023

(30) Foreign Application Priority Data

Mar. 2, 2020 (KR) ..... 10-2020-0026126

(51) Int. Cl.
*A24F 40/30* (2020.01)
*A24F 40/10* (2020.01)
(Continued)

(52) U.S. Cl.
CPC ..... *A24F 40/30* (2020.01); *A24F 40/10* (2020.01); *A24F 40/42* (2020.01); *A24F 40/50* (2020.01)

(58) Field of Classification Search
None
See application file for complete search history.

(56) References Cited

U.S. PATENT DOCUMENTS 10,327,473 B2 6/2019 Mironov
10,477,900 B2 11/2019 Hopps
(Continued)

FOREIGN PATENT DOCUMENTS

CN 104994757 A 10/2015
CN 105792688 A 7/2016
(Continued)

OTHER PUBLICATIONS

Office Action issued Nov. 25, 2021 in Korean Application No. 10-2020-0026126.
(Continued)

*Primary Examiner* — Philip Y Louie
*Assistant Examiner* — Virginia R Bieger
(74) *Attorney, Agent, or Firm* — Sughrue Mion, PLLC

(57) ABSTRACT

An aerosol generating system includes an aerosol generating device including a first vaporizer configured to generate a first aerosol by heating a first liquid composition, a second vaporizer configured to generate a second aerosol by heating a second liquid composition, and a controller configured to control the first vaporizer and the second vaporizer, and an aerosol generating article accommodated in the aerosol generating device and indirectly heated by heat generated by the first vaporizer and the second vaporizer, wherein the controller is configured to control power supplied to the first vaporizer and the second vaporizer, based on a first mode, in
(Continued)

which a smokeless aerosol is generated, and a second mode, in which a transport amount of nicotine included in the aerosol generating article is adjusted.

14 Claims, 6 Drawing Sheets

(51) Int. Cl.
*A24F 40/42* (2020.01)
*A24F 40/50* (2020.01)

(56) References Cited

U.S. PATENT DOCUMENTS

| | | | | |
|---|---|---|---|---|
| 10,716,903 | B2 | 7/2020 | Tucker et al. | |
| 10,881,143 | B2 | 1/2021 | Suzuki et al. | |
| 10,881,148 | B2 | 1/2021 | Nakano et al. | |
| 11,033,055 | B2 | 6/2021 | Fraser et al. | |
| 2016/0022930 | A1 | 1/2016 | Greim et al. | |
| 2016/0309784 | A1 | 10/2016 | Silvestrini et al. | |
| 2016/0331031 | A1* | 11/2016 | Malgat | A24F 40/20 |
| 2017/0119058 | A1† | 5/2017 | Cameron | |
| 2018/0049477 | A1 | 2/2018 | Suzuki et al. | |
| 2018/0184712 | A1 | 7/2018 | Fraser et al. | |
| 2019/0357596 | A1 | 11/2019 | Blick et al. | |
| 2020/0093187 | A1 | 3/2020 | Dickens | |
| 2020/0154773 | A1 | 5/2020 | Lim et al. | |
| 2020/0229501 | A1 | 7/2020 | Han et al. | |
| 2020/0268055 | A1 | 8/2020 | An | |
| 2020/0305512 | A1 | 10/2020 | Lim et al. | |
| 2020/0359698 | A1 | 11/2020 | Lim et al. | |
| 2020/0375249 | A1 | 12/2020 | Yanez | |
| 2021/0195957 | A1 | 7/2021 | Kessler et al. | |
| 2021/0227892 | A1 | 7/2021 | Leah et al. | |

FOREIGN PATENT DOCUMENTS

| | | | | |
|---|---|---|---|---|
| CN | 106686992 | A | 5/2017 | |
| CN | 107529832 | A | 1/2018 | |
| CN | 110234242 | A | 9/2019 | |
| CN | 110799049 | A | 2/2020 | |
| DE | 102017123867 | A1 | 4/2019 | |
| JP | 2016-526873 | A | 9/2016 | |
| KR | 10-2014-0127288 | A | 11/2014 | |
| KR | 1020150129683 | A | 11/2015 | |
| KR | 10-2016-0096590 | A | 8/2016 | |
| KR | 1020160098212 | A | 8/2016 | |
| KR | 10-2016-0112769 | A | 9/2016 | |
| KR | 10-2018-0014090 | A | 2/2018 | |
| KR | 1020180012830 | A | 2/2018 | |
| KR | 10-2018-0070440 | A | 6/2018 | |
| KR | 10-2018-0124739 | A | 11/2018 | |
| KR | 10-1930663 | B1 | 12/2018 | |
| KR | 1020180129995 | A | 12/2018 | |
| KR | 10-2019-0049392 | A | 5/2019 | |
| KR | 10-2019-0049647 | A | 5/2019 | |
| WO | 2016/178377 | A1 | 11/2016 | |
| WO | 2017/141358 | A1 | 8/2017 | |
| WO | WO-2018146455 | A1 * | 8/2018 | A24F 47/00 |
| WO | WO-2018189195 | A1 * | 10/2018 | A24D 1/20 |
| WO | 2019/215213 | A1 | 11/2019 | |

OTHER PUBLICATIONS

Extended European Search Report issued Feb. 16, 2022 in European Application No. 20870444.5.
International Search Report dated Mar. 25, 2021, in International Application No. PCT/KR2020/018373.
Communication dated Jul. 12, 2022 from the Japanese Patent Office in Application No. 2021-527912.
Communication issued Feb. 17, 2025 in Chinese Application No. 202080074738.6.

* cited by examiner
† cited by third party

AEROSOL GENERATING DEVICE AND AEROSOL GENERATING SYSTEM

CROSS REFERENCE TO RELATED APPLICATIONS

This application is a National Stage of International Application No. PCT/KR2020/018373 filed Dec. 15, 2020, claiming priority based on Korean Patent Application No. 10-2020-0026126 filed Mar. 2, 2020.

TECHNICAL FIELD

The present disclosure relates to an aerosol generating device and an aerosol generating system, and more particularly, to an aerosol generating device for generating a smokeless aerosol or a smoke aerosol by controlling power supplied to vaporizers, and an aerosol generating system.

BACKGROUND ART

Recently, the demand for alternative methods to overcome the shortcomings of general cigarettes has increased. For example, there is an increasing demand for a method of generating aerosols by heating an aerosol generating material in cigarettes or liquid storages rather than by burning cigarettes.

However, when using a prior art aerosol generating device, it is impossible to convert a mode, in which a smokeless aerosol is generated, into a mode in which a smoke aerosol is generated, and adjust the transport amount of flavors, nicotine, or the like, depending on the user's preference.

DESCRIPTION OF EMBODIMENTS

Technical Problem

Technical problems to be solved by the present disclosure are to provide an aerosol generating device for adjusting an aerosol generation amount and an aerosol generating system.

The technical problems of the present disclosure are not limited to the above-described description, and other technical problems may be derived from the embodiments to be described hereinafter.

Solution to Problem

According to an aspect of the present disclosure, an aerosol generating system includes an aerosol generating device including a first vaporizer configured to generate a first aerosol by heating a first liquid composition, a second vaporizer configured to generate a second aerosol by heating a second liquid composition, and a controller configured to the first vaporizer and the second vaporizer, and an aerosol generating article accommodated in the aerosol generating device and indirectly heated by heat generated by the first vaporizer and the second vaporizer, wherein the controller is configured to control power supplied to the first vaporizer and the second vaporizer, based on a first mode, in which a smokeless aerosol is generated, and a second mode, in which a transport amount of nicotine included in the aerosol generating article is adjusted.

According to another aspect of the present disclosure, an aerosol generating device includes a hollow, into which an aerosol generating article is inserted, a first vaporizer configured to generate a first aerosol by heating a first liquid composition, a second vaporizer configured to generate a second aerosol by heating a second liquid composition, a battery configured to supply power to the first vaporizer and the second vaporizer, and a controller configured to control the first vaporizer and the second vaporizer. The first vaporizer and the second vaporizer indirectly heat the aerosol generating article inserted into the hollow, and the controller is configured to control the power supplied to the first vaporizer and the second vaporizer, based on a first mode, in which a smokeless aerosol is generated, and a second mode, in which the transport amount of nicotine included in the aerosol generating article is adjusted.

Advantageous Effects of Disclosure

According to necessity, in an aerosol generating system and an aerosol generating device, a smokeless mode in which a smokeless aerosol is generated may be converted to a smoke mode in which a smoke aerosol is generated.

Also, in the aerosol generating system and the aerosol generating device, the transport amount of flavors, nicotine, or the like may be adjusted according to the user preference.

Also, because a cigarette is indirectly heated by heat generated by vaporizers, an additional heater for heating a cigarette is not required, and the amount of consumed power decreases accordingly.

Effects of the present disclosure are not limited to the descriptions above, and various effects are stated in the present specification.

BEST MODE

Figure 1:
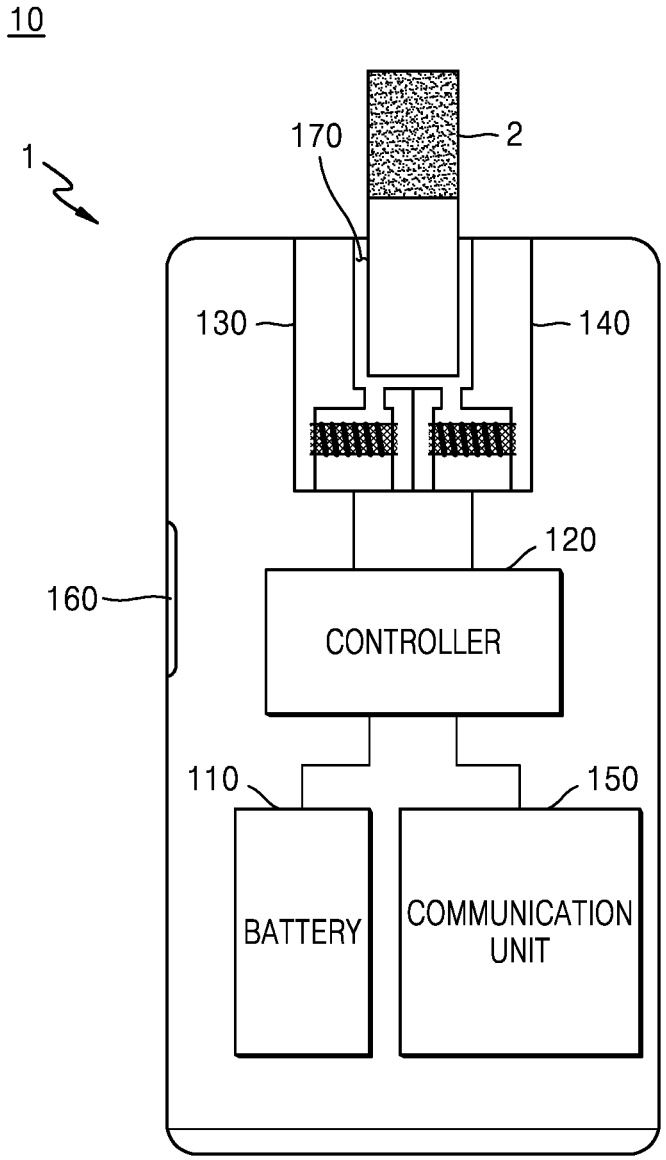
FIG. 1 illustrates an aerosol generating system.

According to an aspect of the present disclosure, an aerosol generating system includes an aerosol generating device including a first vaporizer configured to generate a first aerosol by heating a first liquid composition, a second vaporizer configured to generate a second aerosol by heating a second liquid composition, and a controller configured to the first vaporizer and the second vaporizer, and an aerosol generating article accommodated in the aerosol generating device and indirectly heated by heat generated by the first vaporizer and the second vaporizer, wherein the controller is configured to control power supplied to the first vaporizer and the second vaporizer, based on a first mode, in which a smokeless aerosol is generated, and a second mode, in which a transport amount of nicotine included in the aerosol generating article is adjusted.

The aerosol generating device may include a hollow into which the aerosol generating article is inserted, and the hollow may be generated as the first vaporizer and the second vaporizer are coupled to each other.

The first vaporizer and the second vaporizer may be integrally formed, and the first vaporizer and the second vaporizer, which are integrally formed, may include a hollow into which the aerosol generating article is inserted. The first vaporizer may include a first liquid storage storing the first liquid composition, the second vaporizer may include a second liquid storage storing the second liquid composition, and the first liquid storage and the second liquid storage may be divided by a partition.

The first vaporizer and the second vaporizer may be arranged to allow at least one of the first aerosol and the second aerosol to pass through the aerosol generating article.

The first liquid composition may include a first moisturizer, and the first moisturizer may include a mixture in which vegetable glycerin and propylene glycol are mixed at a certain ratio.

A ratio of the vegetable glycerin to the propylene glycol in the first moisturizer may be between about 4:1 and about 9:1.

The second liquid composition may include a second moisturizer, and the second moisturizer may only include propylene glycol.

The aerosol generating article may include a tobacco medium container and a filter.

The nicotine may be contained in the tobacco medium container.

The aerosol generating article may further include a heat-conducting wrapper surrounding the tobacco medium container and configured to deliver, to the tobacco medium container, heat generated by the first vaporizer and the second vaporizer.

The aerosol generating device may include a hollow into which the aerosol generating article is inserted, and the first vaporizer and the second vaporizer may be configured to indirectly heat the aerosol generating article by heating the hollow.

The first vaporizer and the second vaporizer may be configured to indirectly heat the aerosol generating article at a temperature ranging from about 150 degrees Celsius to about 250 degrees Celsius.

The controller may be configured to supply power only to the second vaporizer in the first mode.

The controller may be configured to, in the second mode, selectively supply power to the second vaporizer while supplying power to the first vaporizer.

The aerosol generating device may further include a communication unit configured to communicate with an external device.

The communication unit may be configured to receive a remote control signal from the external device, and the controller may be configured to control power supplied to the first vaporizer and the second vaporizer, based on remote control signal.

According to another aspect of the present disclosure, an aerosol generating device includes a hollow, into which an aerosol generating article is inserted, a first vaporizer configured to generate a first aerosol by heating a first liquid composition, a second vaporizer configured to generate a second aerosol by heating a second liquid composition, a battery configured to supply power to the first vaporizer and the second vaporizer, and a controller configured to control the first vaporizer and the second vaporizer. The first vaporizer and the second vaporizer indirectly heat the aerosol generating article inserted into the hollow, and the controller is configured to control the power supplied to the first vaporizer and the second vaporizer, based on a first mode, in which a smokeless aerosol is generated, and a second mode, in which the transport amount of nicotine included in the aerosol generating article is adjusted.

The first liquid composition may include a first moisturizer, and the first moisturizer may include a mixture in which vegetable glycerin and propylene glycol are mixed at a certain ratio.

The second liquid composition may include a second moisturizer, and the second moisturizer may only include propylene glycol.

The controller may be configured to supply power only to the second vaporizer in the first mode, and to selectively supply power to the second vaporizer while supplying power to the first vaporizer, in the second mode.

MODE OF DISCLOSURE

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. An aerosol generating device and an aerosol generating system may be embodied in many different forms and should not be construed as being limited to the embodiments set forth herein.

It will be understood that the terms "upstream" and "downstream" are used to indicate relative locations of segments forming an aerosol generating article, based on a direction in which a user inhales air by using the aerosol generating article. The aerosol generating article includes a downstream end portion (that is, a portion through which air is introduced) and an upstream end portion (that is, a portion through which air is discharged). When the aerosol generating article is used, a user may hold the downstream end portion of the aerosol generating article. The downstream end portion may be located in a downstream portion of the upstream end portion. The term "end portion" may be described as an "end."

In embodiments below, outputs of vaporizers may have the same meaning as power consumed by the vaporizers.

In embodiments below, the term "indirect heating" may not indicate that a heating element (e.g., a heater) directly contacts an aerosol generating article 2 to directly heat the aerosol generating article 2, but may indicate that the heating element heats a heat medium element (e.g., air) and the heat medium element transfers heat to the aerosol generating article 2 through convection, radiation, etc.

Sizes of components in the drawings may be exaggerated for convenience of explanation. In other words, since sizes and thicknesses of components in the drawings are arbitrarily illustrated for convenience of explanation, the following embodiments are not limited thereto.

Hereinafter, one or more embodiments will be described in detail with reference to the attached drawings.

FIG. 1 illustrates an aerosol generating system.

Referring to the drawing, an aerosol generating system 10 may include an aerosol generating device 1 and an aerosol generating article 2.

The aerosol generating device 1 may include a battery 110, a controller 120, a first vaporizer 130, a second vaporizer 140, a communication unit 150, and an input unit 160 Also, the aerosol generating device 1 may further include a hollow 170 accommodating the aerosol generating article 2.

FIG. 1 illustrates components related to the present embodiment. Therefore, one of ordinary skill in the art could understand that other general-purpose components, other than the components of FIG. 1, may be further included in the aerosol generating device 1.

Also, the arrangements of the battery 110, the controller 120, the first vaporizer 130, the second vaporizer 140, the communication unit 150, and the input unit 160 are merely examples, and an internal structure of the aerosol generating device 1 is not limited to the illustration of FIG. 1. In other words, according to a design of the aerosol generating device 1, the arrangements of the battery 110, the controller 120, the first vaporizer 130, the second vaporizer 140, the communication unit 150, and the input unit 160 may be changed.

When the aerosol generating article 2 is inserted into the aerosol generating device 1, the aerosol generating device 1 may operate at least any one of the first vaporizer 130 and the second vaporizer 140, thus generating an aerosol. The aerosol generated by the first vaporizer 130 and/or the second vaporizer 140 may be delivered to the user by passing through the aerosol generating article 2.

According to necessity, even when the aerosol generating article 2 is not inserted into the aerosol generating device 1, the aerosol generating device 1 may heat the first vaporizer 130 and/or the second vaporizer 140.

The battery 110 may supply power necessary to drive the aerosol generating device 1. For example, the battery 110 may supply power to heat the first vaporizer 130 and the second vaporizer 140 and power necessary to drive the controller 120. Also, the battery 110 may supply power necessary to drive a display, a sensor, a motor, and the like installed in the aerosol generating device 1.

The controller 120 may control all operations of the aerosol generating device 1. In detail, the controller 120 may control operations of the battery 110, the first vaporizer 130, the second vaporizer 140, and other components included in the aerosol generating device 1. Also, the controller 120 may identify a state of each component of the aerosol generating device 1 and determine whether the aerosol generating device 1 is operable.

The controller 120 may include at least one processor. A processor can be implemented as an array of a plurality of logic gates or can be implemented as a combination of a general-purpose microprocessor and a memory in which a program executable in the microprocessor is stored. Also, it will be understood by one of ordinary skill in the art that the processor can be implemented in other forms of hardware.

The hollow 170 may accommodate the aerosol generating article 2. The hollow 170 may extend along a lengthwise direction of the aerosol generating device 1.

Heat generated by the first vaporizer 130 and the second vaporizer 140 may heat air existing in the hollow 170, and the aerosol generating article 2 may be indirectly heated by the heated air. In other words, because the heat generated by the first vaporizer 130 and the second vaporizer 140 is transferred to the aerosol generating article 2 through the hollow 170, the hollow 170 functions as a space, where the aerosol generating article 2 is accommodated, as well as a heating chamber.

An aerosol may be generated by heating liquid compositions in the first vaporizer 130 and the second vaporizer 140, and the generated aerosol may be delivered to the user by passing through the aerosol generating article 2.

The first vaporizer 130 and the second vaporizer 140 may be accommodated in the aerosol generating device 1 while containing the liquid compositions. When the liquid compositions are completely consumed, the first vaporizer 130 and the second vaporizer 140 may be replaced with new vaporizers. According to an embodiment, liquid storages 131 and 141 (of FIG. 2) storing the liquid compositions may only be replaced.

The liquid compositions may include aerosol generating materials used to generate aerosols. The first vaporizer 130 and the second vaporizer 140 may respectively change phases of the aerosol generating materials inside the first vaporizer 130 and the second vaporizer 140 to gaseous phases, thereby generating the aerosols. The aerosol may refer to a gas in which vaporized particles generated from an aerosol generating material are mixed with air.

For example, the first vaporizer 130 and the second vaporizer 140 may respectively convert the phases of the aerosol generating materials by receiving electrical signals from the controller 120 and heating the aerosol generating materials, or by using an induction heating method.

The first vaporizer 130 and the second vaporizer 140 may include heating elements for heating the aerosol generating materials. The first vaporizer 130 and the second vaporizer 140 may indirectly heat the aerosol generating article 2 by using the heating elements.

The first vaporizer 130 may include a liquid composition for generating a smoke aerosol. The second vaporizer 140 may include a liquid composition for generating a smokeless aerosol.

The controller 120 may control the power supplied to the first vaporizer 130 and the second vaporizer 140 and thus may adjust the generation, the generated amount, and the like of the smoke aerosol and/or the smokeless aerosol.

The controller 120 may control the power supplied to the first vaporizer 130 and the second vaporizer 140 according to a first mode, in which a smokeless aerosol is generated, and a second mode, in which the transport amount of nicotine included in an aerosol generating article 2 is adjusted.

Because of power supply to the first vaporizer 130, a first aerosol that is a smoke aerosol may be generated. Also, when power is supplied to the second vaporizer 140, a second aerosol that is a smokeless aerosol may be generated.

The aerosol generating article 2 may be indirectly heated by the first vaporizer 130. Alternatively, the aerosol generating article 2 may be indirectly heated by the first vaporizer 130 and the second vaporizer 140.

The first aerosol and the second aerosol may be delivered to the user by passing through the aerosol generating article 2. In this case, the first aerosol and the second aerosol may be used to deliver, to the user, nicotine included in the aerosol generating article 2.

An indirect heating method of the first vaporizer 130 and the second vaporizer 140 and a power control method according to each mode will be described in detail with reference to FIG. 2.

The input unit 160 may receive a user input. For example, the input unit 160 may be a pressure-type push button.

When receiving an operation command of the aerosol generating device 1, the input unit 160 may transmit a control signal corresponding to the operation command to the controller 120. For example, the operation command may include an on/off command, a mode change command, a power control command, a command for communication with an external device, or the like. The controller 120 may control each component inside the aerosol generating device 1, based on the control signal.

The communication unit 150 may communicate with an external device 3 (of FIG. 6) in a wired and/or wireless manner. To this end, the communication unit 150 may include one or more communication modules. For example, the communication unit 150 may include a Wi-Fi communication module, an NFC communication module, a Zigbee communication module, a Bluetooth communication module, or the like.

The external device 3 may include a desktop computer and a fixed terminal equivalent thereto, or a portable device such as a laptop, a tablet computer, or a mobile phone.

The aerosol generating device 1 may further include general-purpose components in addition to the battery 110, the controller 120, the first vaporizer 130, the second vaporizer 140, the communication unit 150, and the input unit 160. For example, the aerosol generating device 1 may include a display capable of outputting visual information and/or a motor for outputting tactile information. Also, the aerosol generating device 1 may include at least one sensor (a puff detection sensor, a temperature detection sensor, or the like). Also, the aerosol generating device 1 may have a structure in which, even when the aerosol generating article 2 is inserted, external air may be introduced or internal air may be discharged.

Figure 2:
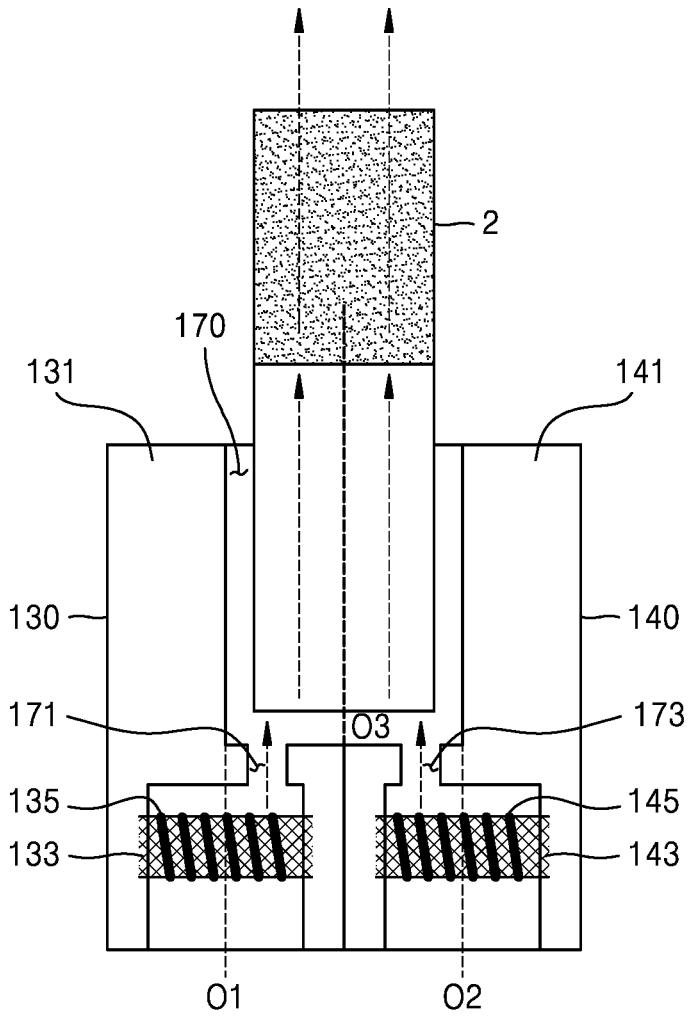
FIG. 2 illustrates a first vaporizer, a second vaporizer, and an aerosol generating article of FIG. 1.

FIG. 2 illustrates a first vaporizer, a second vaporizer, and an aerosol generating article of FIG. 1.

Referring to the drawing, the first vaporizer 130 and the second vaporizer 140 may heat the liquid compositions and respectively generate the first aerosol and the second aerosol, and the generated first and second aerosols may be delivered to the user by passing through the aerosol generating article 2. In this case, the first vaporizer 130 generates smoke to make the user feel the same way as smoking a combustive cigarette, and the second vaporizer 140 adjusts the transport amount of nicotine included in the aerosol generating article 2.

In detail, the first vaporizer 130 may include a first liquid storage 131, a first liquid delivery element 133, and the first heater 135. The second vaporizer 140 may include a second liquid storage 141, a second liquid delivery element 143, and the second heater 145.

The first liquid storage 131 may store the first liquid composition. The first liquid composition may be a liquid including a non-tobacco material. When heated, the first liquid composition may generate smoke. In other words, the first liquid composition may be a non-tobacco material capable of generating smoke, and the first aerosol generated when the first liquid composition is heated may be a smoke aerosol.

The first liquid composition may include a first moisturizer. In an embodiment, the first moisturizer may include Vegetable Glycerin (VG). In another embodiment, the first moisturizer may include VG and propylene glycol to improve a physical property (flow) of the first liquid composition. In this case, a ratio of VG to propylene glycol may be between about 4:1 and about 9:1.

The first liquid composition may include water, a solvent, ethanol, plant extract, spices, flavorings, or a vitamin mixture, in addition to the first moisturizer. However, the first liquid composition may not include nicotine. Accordingly, the aerosol generating device 1 may vaporize the first liquid composition with low power.

The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto.

The second liquid storage 141 may store a second liquid composition. The second liquid composition may be a liquid including a tobacco-containing material having a volatile tobacco flavor component, or a liquid including a non-tobacco material. Even when heated, the second liquid composition may not generate smoke. In other words, the second liquid composition may be a non-tobacco material that does not generate smoke, and the second aerosol generated when the second liquid composition is heated may be a smokeless aerosol. By passing through the aerosol generating article 2, the second aerosol may transfer nicotine included in the aerosol generating article 2 to the outside of the aerosol generating article 2.

The second liquid composition may include a second moisturizer. In an embodiment, the second moisturizer may only include propylene glycol. In another embodiment, the second moisturizer may further include ethylene glycol, dipropylene glycol, diethylene glycol, triethylene glycol, tetraethylene glycol, oleyl alcohol, and the like. Also, the second liquid composition may further include water, a solvent, ethanol, plant extract, spices, flavorings, or a vitamin mixture. However, the second liquid composition may not include nicotine. Accordingly, the aerosol generating device 1 may vaporizer the second liquid composition with low power.

The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto.

The first liquid delivery element 133 may deliver the first liquid composition to the first heater 135. The second liquid delivery element 143 may deliver the second liquid composition to the second heater 145. For example, the first liquid delivery element 133 and the second liquid delivery element 143 may each be a wick such as cotton fiber, ceramic fiber, glass fiber, or porous ceramic, but are not limited thereto.

The first heater 135 may heat the first liquid composition delivered by the first liquid delivery element 133. The second heater 145 may heat the second liquid composition delivered by the second liquid delivery element 143. For example, the first heater 135 and the second heater 145 may each be a metal heating wire, a metal hot plate, a ceramic heater, or the like, but are not limited thereto. Also, the first heater 135 and the second heater 145 may each include a conductive filament such as nichrome wire and may be wound around the first and second liquid delivery elements 133 and 143. The first heater 135 and the second heater 145 may be heated by a current supply and may transfer heat to the first and second liquid compositions in contact with the first heater 135 and the second heater 145, thereby heating the liquid compositions. As a result, the first aerosol and/or the second aerosol may be generated. Also, the first aerosol and/or the second aerosol may pass through the aerosol generating article 2 and may be delivered to the user.

The first vaporizer 130 and the second vaporizer 140 may each be referred to as a cartomizer or an atomizer, but are not limited thereto.

The aerosol generating article 2 may be accommodated in the aerosol generating device 1 and may be indirectly heated by the first vaporizer 130 and the second vaporizer 140.

The aerosol generating article 2 may be inserted into the aerosol generating device 1 through the hollow 170. When the aerosol generating article 2 is inserted into the aerosol generating device 1 through the hollow 170, an upstream end of the aerosol generating article 2 may be adjacent to the first heater 135 and the second heater 145.

The hollow 170 may include a first through hole 171 in fluid connection with the first heater 135 and a second through hole 173 in fluid connection with the second heater 145. To increase the heat delivery efficiency, the first through hole 171 is positioned between a vertical centerline 01 of the first heater 135 and a vertical centerline 03 of the hollow 170, and the second through hole 173 is positioned between a vertical centerline 02 of the second heater 145 and the vertical centerline 03 of the hollow 170. In this case, a vertical direction may be identical to the lengthwise direction of the aerosol generating device 1.

The first heater 135 may heat the first liquid composition included in the first liquid delivery element 133 as well as air existing in the hollow 170. The second heater 145 may heat the second liquid composition included in the second liquid delivery element 143 as well as the air existing in the hollow 170. The heated air existing in the hollow 170 may heat the aerosol generating article 2. In other words, the aerosol generating article 2 may be indirectly heated by the first hater 135 and/or the second heater 145 for generating the first aerosol and/or the second aerosol.

The first hater 135 and/or the second heater 145 may indirectly heat the aerosol generating article 2 in a first temperature range. The first temperature range may be between about 150 degrees Celsius and about 250 degrees Celsius. The first heater 135 and the second heater 145 may directly heat the first liquid composition and the second liquid composition, respectively, in a second temperature range greater than the first temperature range. The second temperature range may be between about 250 degrees Celsius and about 300 degrees Celsius.

The controller 120 may control power supplied to the first vaporizer 130 and the second vaporizer 140, based on a first mode, in which a smokeless aerosol is generated, and a second mode, in which the transport amount of nicotine included in the aerosol generating article 2 is adjusted.

The controller 120 may supply power only to the second vaporizer 140 to generate the smokeless aerosol in the first mode.

As the power is supplied to the second vaporizer 140, the second aerosol that is the smokeless aerosol may be generated. Also, as the second vaporizer 140 is heated, the aerosol generating article 2 may be indirectly heated. The second aerosol may be delivered to the user by passing through the aerosol generating article 2. In this case, the second aerosol may be used to transport the nicotine included in the aerosol generating article 2.

The first mode may include sub-modes. The controller 120 may supply the power to the second vaporizer 140 to enable an output of the second vaporizer 140 to range from about 50% to about 100% of a maximum output of the second vaporizer 140, according to the sub-modes.

The sub-modes may include a first sub-mode, in which a smokeless aerosol is generated with minimum power, and a second sub-mode, in which the transport amount of nicotine included in the second liquid composition is maximized. According to an embodiment, the number of sub-modes may increase.

A temperature of the second heater 145 has to be higher than a vaporization temperature of the second liquid composition to allow the second vaporizer 140 to generate the smokeless aerosol. Therefore, the minimum power may be set based on the vaporization temperature of the second liquid composition. In an embodiment, the minimum power may denote power consumed by a heating element of the second vaporizer 140 when the heating element of the second vaporizer 140 has the vaporization temperature of the second liquid composition. For example, the minimum power may be identical to power consumed by the second vaporizer 140 when the second vaporizer 140 operates at 50% of the maximum output. In other words, the controller 120 may supply power to the second vaporizer 140 to allow the second vaporizer 140 to operate at 50% of the maximum power in the first sub-mode.

Because the transport amount of nicotine included in the second liquid composition is proportional to the output of the second vaporizer 140, the second vaporizer 140 has to operate at the maximum output (100%) to maximize the transport amount of nicotine included in the second liquid composition. Therefore, the controller 120 may supply the power to the second vaporizer 140 to allow the second vaporizer 140 to operate at the maximum power (100%) in the second sub-mode.

The second mode may also include sub-modes. The controller 120 may supply power to the first vaporizer 130 to enable an output of the first vaporizer 130 to be in a range from about 80% to about 100% of the maximum power of the first vaporizer 130, and power to the second vaporizer 140 to enable an output of the second vaporizer 140 to be in a range from about 0% to about 70% of the maximum power of the second vaporizer 140, corresponding to the sub-modes.

The sub-modes may include a third sub-mode, in which the amount of smoke is maximized and the transport amount of nicotine is minimized, and a fourth sub-mode that is a normal mode. According to an embodiment, the number of sub-modes may increase.

The amount of smoke may increase proportionally to a temperature of a first heater 135 included in the first vaporizer 130, and thus, the first vaporizer 130 has to operate at the maximum output (100%) to maximize the amount of smoke. On the contrary, the second vaporizer 140 has to operate at a minimum output to minimize the transport amount of nicotine. Therefore, in the third sub-mode, the controller 120 may supply the power to the first vaporizer 130 to allow the first vaporizer 130 to operate at the maximum power (100%) and may not supply power to the second vaporizer 140. Unlike in the second sub-mode, the reason why the power is not supplied to the second vaporizer 140 in the third sub-mode is the first aerosol is generated by the first vaporizer 130.

The fourth sub-mode may correspond to the normal mode. The fourth sub-mode may be a mode for an appropriate amount of transported nicotine and an appropriate amount of smoke. In the fourth sub-mode, the controller 120 may supply power to the first vaporizer 130 to make the first vaporizer 130 operate at 80% of the maximum output, and supply power to the second vaporizer 140 to make the second vaporizer 140 operate at 70% of the maximum output.

Figure 3:
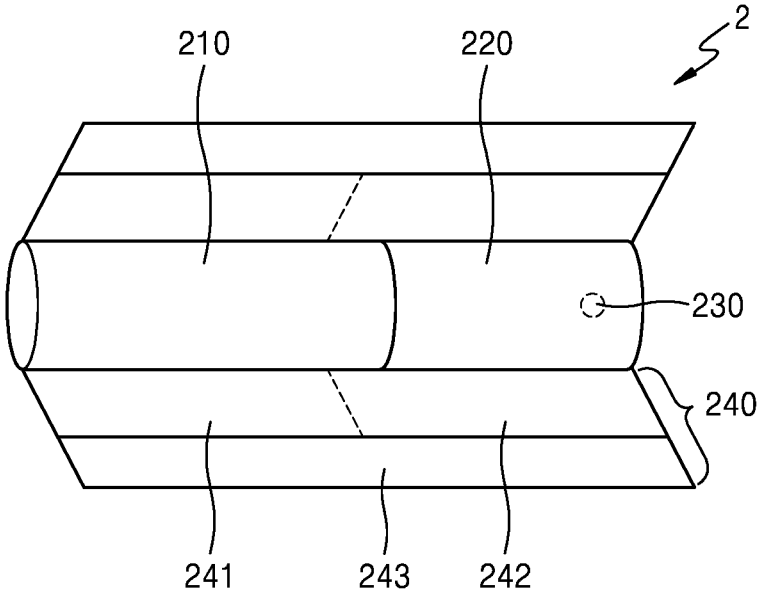
FIG. 3 is an exploded view of an aerosol generating article.

FIG. 3 is an exploded view of an aerosol generating article.

Referring to the drawing, the aerosol generating article 2 may include a tobacco medium container 210 and a filter 220. However, because the aerosol generating article 2 is indirectly heated by the first vaporizer 130 and the second vaporizer 140, the aerosol generating article 2 may not include a cooling element to compensate for heat loss according to the indirect heating.

The tobacco medium container 210 may have a cylindrical shape. The smoke and/or the aerosol may be generated from a tobacco medium, and the generated smoke and/or aerosol may be inhaled by the user through the filter 220.

The tobacco medium container 210 may include solid materials including tobacco ingredients such as tobacco sheets, cut tobaccos, and reconstituted tobaccos. In an embodiment, the tobacco medium container 210 may be filled with corrugated tobacco sheets. The tobacco sheet may be corrugated by being rolled, folded, compressed, or contracted in a substantially horizontal direction to a cylindrical axis. The porosity may be determined by adjusting gaps between ridges, etc. of the corrugated tobacco sheet.

In another embodiment, the tobacco medium container 210 may be filled with cut tobaccos. Here, cut tobaccos may be generated by cutting a tobacco sheet (or a slurry tobacco sheet) into tiny pieces. Also, the tobacco medium container 210 may be formed as tobacco strands are combined in the same direction (parallel) or randomly. In detail, the tobacco medium container 210 may be formed as the tobacco strands are combined, and channels, through which an aerosol may pass, may be formed in a longitudinal direction. In this case, because of sizes and arrangements of tobacco strands, channels in a longitudinal direction may be uniform or non-uniform.

The tobacco medium container 210 may include a moisturizer for providing moisture in an aerosol. The moisture may include glycerin, propylene glycol, and water. Also, the moisturizer may further include at least one of ethylene glycol, dipropylene glycol, diethylene glycol, triethylene glycol, tetraethylene glycol, and oleyl alcohol, but it is not limited thereto. Also, the tobacco medium container 210 may further include nicotine.

The moisturizer in the tobacco medium container 210 may smoothen taste of the tobacco by maintaining moisture in the aerosol, which is generated while the aerosol generating article 2 is heated, to an appropriate level, thus increasing the amount of smoke.

Also, the tobacco medium container 210 may include other additives, such as flavors and/or organic acid. For example, the flavor may include licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, cinnamon, caraway, cognac, jasmine, chamomile, menthol, Chinese cinnamon, ylang-ylang, sage, spearmint, ginger, coriander, coffee, or the like.

The filter 220 may include at least one of a tube filter and a recess filter. The tube filter may have a shape including a hollow therein. The tube filter and the recess filter may be manufactured using a cellulose-based material (e.g., paper, acetate, etc.).

The filter 220 may include at least one capsule 230. The capsule 230 may generate a flavor or an aerosol. For example, the capsule 230 may have a configuration in which a liquid containing a flavoring material is wrapped with a film. The capsule 230 may have a spherical or cylindrical shape, but is not limited thereto.

The aerosol generating article 2 may be wrapped by at least one wrapper 240. In the wrapper 240, at least one hole, through which external air is introduced or internal air is discharged, may be formed. The aerosol generating article 2 may be doubly packaged via at least two wrappers 26.

The tobacco medium container 210 may be packaged by a first wrapper 241, and the filter 220 may be packaged by a second wrapper 242. Also, the first wrapper 241 and the second wrapper 242 may be re-packaged by a third wrapper 243. In other words, the tobacco medium container 210 and the filter 220 may be further packaged by the third wrapper 243.

The first wrapper 241 may be a heat-conducting wrapper to maximize an indirect heating effect by the first vaporizer 130 and the second vaporizer 140. The heat-conducting wrapper may package the tobacco medium container 210 and may deliver the heat, which is generated by the first vaporizer 130 and the second vaporizer 140, to the tobacco medium container 210. For example, the first wrapper may be, but is not limited to, a metal foil such as aluminum foil.

The second wrapper 242 may be hard wrapping paper.

The third wrapper 243 may include a certain material. Here, a certain material may be silicon, but is not limited thereto. For example, silicon has a property such as heat resistance with little temperature change, oxidation resistance of preventing oxidation, resistance to various medicines, water repellency, or electric insulation. However, although the certain material is not silicon, any material having the above-described properties may be spread (or coated) on the third wrapper 243. The third wrapper 243 may prevent the aerosol generating article 2 from being combusted.

Also, the third wrapper 243 may prevent the aerosol generating device 1 from being contaminated by materials generated by the aerosol generating article 2. Liquid materials may be generated in the aerosol generating article 2 because of a user's puff. For example, as the aerosol generated by the aerosol generating article 2 is cooled by external air, liquid materials (e.g., moisture, etc.) may be generated. As the third wrapper 243 packages the tobacco medium container 210 and the filter 220, the third wrapper 243 may prevent the leakage of the liquid materials, which are generated in the aerosol generating article 2, to the outside of the aerosol generating article 2. Therefore, the contamination of an interior of the aerosol generating device 1 by the liquid materials generated by the aerosol generating article 2 may be prevented.

Figure 4:
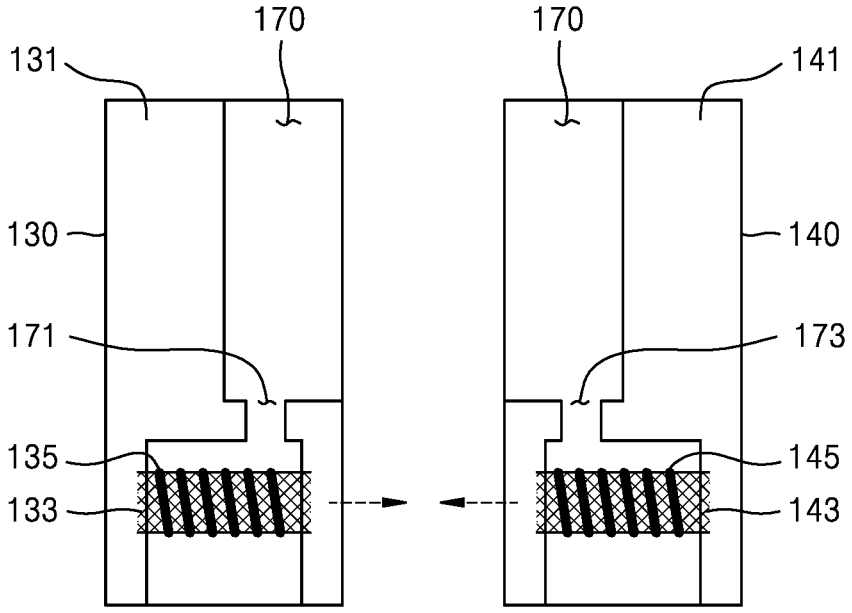
FIG. 4 is a diagram for explaining a method of coupling a first vaporizer and a second vaporizer, and a hollow formation method, according to an embodiment.

FIG. 4 is a diagram for explaining a method of coupling a first vaporizer and a second vaporizer and a hollow formation method, according to an embodiment.

Referring to the drawing, the first vaporizer 130 and the second vaporizer 140 may be detachably coupled to each other.

For example, any one of the first vaporizer 130 and the second vaporizer 140 may include a hook, and the other thereof may include a locking hook. Thus, the first vaporizer 130 and the second vaporizer 140 may be coupled to each other.

As another example, any one of the first vaporizer 130 and the second vaporizer 140 may include a protrusion, and the other thereof may include a groove corresponding to the protrusion. Thus, the first vaporizer 130 and the second vaporizer 140 may be coupled to each other in a fitting manner.

However, a method of coupling the first vaporizer 130 to the second vaporizer 140 is not limited thereto. When the first vaporizer 130 and the second vaporizer 140 are detachably coupled to each other, the coupling method is not limited to the above method.

Because of the coupling of the first vaporizer 130 and the second vaporizer 140 to each other, the hollow 170, in which the aerosol generating article 2 is accommodated, may be generated.

The aerosol generating device 1 may operate in the first mode, in which the smokeless aerosol is generated, or the second mode, in which the transport amount of nicotine is adjusted, and thus, consumption degrees of the first liquid composition and the second liquid composition may differ according to a use pattern of the user. The aerosol generating device 1 according to an embodiment has the advantage that a consumed vaporizer is only replaced.

Figure 5:
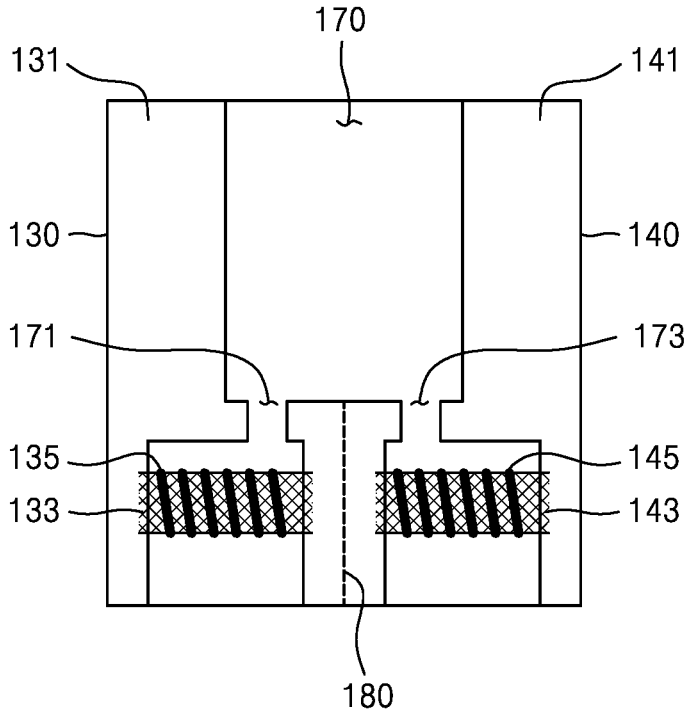
FIG. 5 is a diagram for explaining a method of coupling a first vaporizer and a second vaporizer and a hollow formation method, according to another embodiment.

FIG. 5 is a diagram for explaining a method of coupling a first vaporizer and a second vaporizer and a hollow formation method, according to another embodiment.

Referring to the drawing, the first vaporizer 130 and the second vaporizer 140 according to another embodiment may be integrally formed. In this case, the first liquid storage 131 and the second liquid storage 142 may be divided by a partition 180.

The hollow 170, in which the aerosol generating article 2 is accommodated, may be formed by the first vaporizer 130 and the second vaporizer 140 that are integrally formed.

When the first vaporizer 130 and the second vaporizer 140 are integrally formed, the ease of manufacture may increase.

Figure 6:
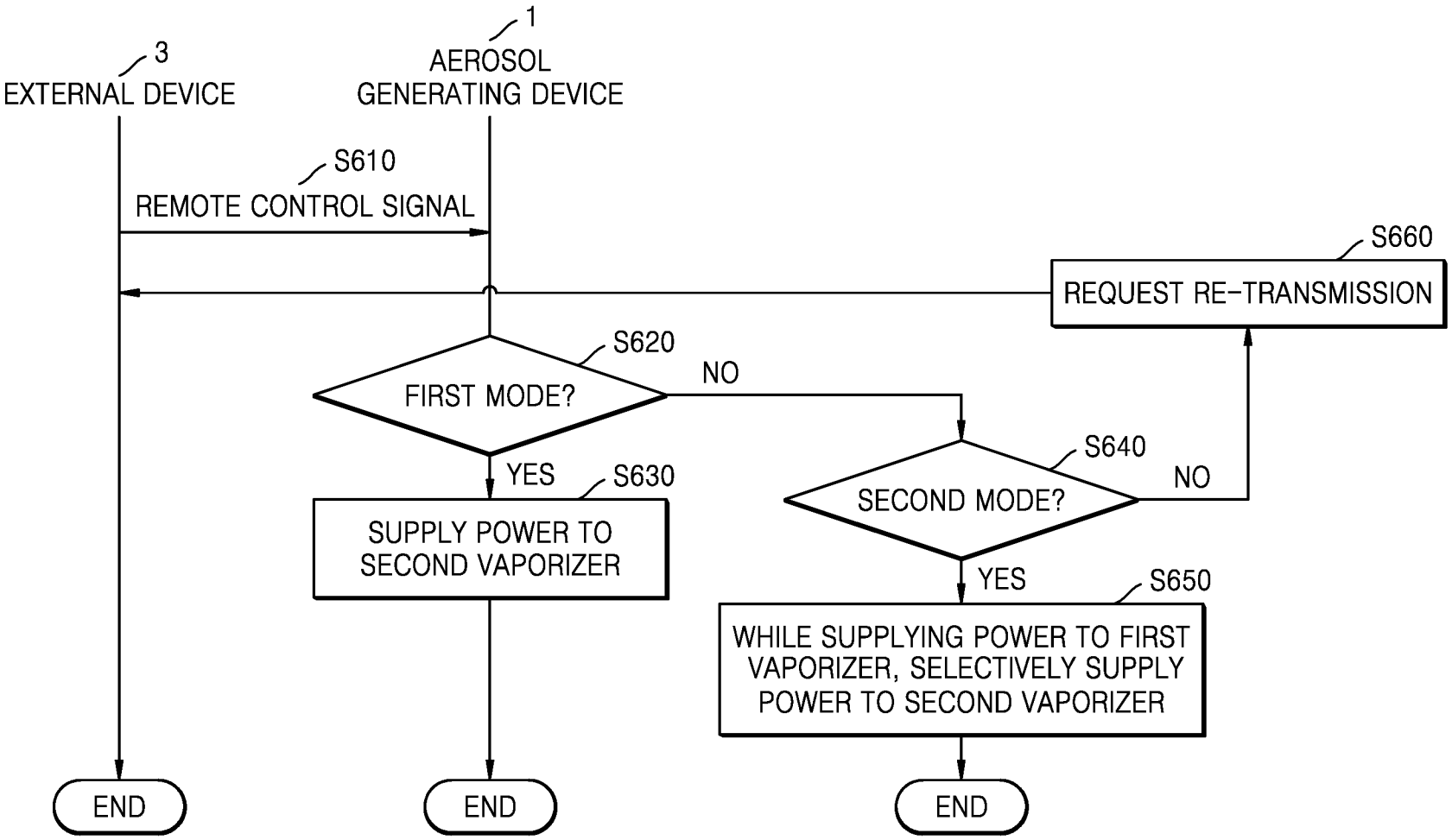
FIG. 6 is a flowchart of an operation method of an aerosol generating system.

FIG. 6 is a flowchart of an operation method of an aerosol generating system.

Referring to the drawing, in operation S610, the external device 3 may transmit a remote control signal to the aerosol generating device 1 in a wireless or wired manner. The remote control signal may include mode selection information and power control information.

The communication unit 150 included in the aerosol generating device 1 may receive the remote control signal. To this end, the communication unit 150 may include one or more communication modules. For example, the communication unit 150 may include a Wi-Fi communication module, an NFC communication module, a Zigbee communication module, a Bluetooth communication module, or the like.

In operation S620, the controller 120 may analyze an operation mode based on remote control signal received by the communication unit 150. The controller 120 may analyze the operation mode based on the mode selection information.

The operation mode may include the first mode, in which the smokeless aerosol is generated, and the second mode, in which the transport amount of nicotine included in the aerosol generating article 2 is adjusted.

In operation S630, the controller 120 may provide power only to the second vaporizer 140 when the operation mode included in the mode selection information is the first mode. In other words, when the operation mode is the first mode, the controller 120 may not provide power to the first vaporizer 130.

The second vaporizer 140 may include the second liquid composition used to generate the smokeless aerosol. In an embodiment, the second liquid composition may include the second moisturizer, and the second moisturizer may only include propylene glycol.

Because of the power supply to the second vaporizer 140, the second aerosol that is smokeless may be generated. Also, as the second vaporizer 140 is heated, the aerosol generating article 2 may be indirectly heated. The second aerosol may be delivered to the user by passing through the aerosol generating article 2. In this case, the second aerosol may be used to deliver, to the user, the nicotine included in the aerosol generating article 2.

The first mode may include sub-modes. The controller 120 may supply power to the second vaporizer 140 to enable the output of the second vaporizer 140 to be in a range from about 50% to about 100% of the maximum output of the second vaporizer 140, corresponding to the sub-modes.

In operation S640, when the operation mode included in the mode selection information is not the first mode, the controller 120 may analyze whether the operation mode is the second mode.

In operation S650, when the operation mode is the second mode, the controller 120 may selectively supply power to the second vaporizer 140 while supplying power to the first vaporizer 130.

The first vaporizer 130 may include the first liquid composition used to generate the smoke aerosol. The first liquid composition may include a first moisturizer. In an embodiment, the first moisturizer may only include VG. In another embodiment, the first moisturizer may be a mixture in which VG and propylene glycol are mixed at a certain ratio. For example, a ratio of VG to propylene glycol may be between about 4:1 and about 9:1. When the first moisturizer further includes propylene glycol, a physical property (flow) of the first liquid composition may be improved.

Because of power supply to the first vaporizer 130, the first aerosol that is a smoke aerosol may be generated. Also, when power is supplied to the second vaporizer 140, the second aerosol that is a smokeless aerosol may be generated.

The aerosol generating article 2 may be indirectly heated by the first vaporizer 130. Alternatively, the aerosol generating article 2 may be indirectly heated by the first vaporizer 130 and the second vaporizer 140.

The first aerosol and the second aerosol may be delivered to the user by passing through the aerosol generating article 2. In this case, the first aerosol and the second aerosol may be used to deliver the nicotine included in the aerosol generating article 2 to the user.

The second mode may include sub-modes. The controller 120 may supply power to the first vaporizer 130 to enable the output of the first vaporizer 130 to be in a range from about 80% to about 100% of the maximum output of the first vaporizer 130 and power to the second vaporizer 140 to enable the output of the second vaporizer 140 to be in a range from about 0% to about 70% of the maximum output of the second vaporizer 140, corresponding to the sub-modes.

In operation S660, when the operation mode is neither the first mode nor the second mode, the controller 120 may determine that an error occurs and thus may send a request for re-transmission of a remote control signal.

The above-described method can be written as computer programs and can be implemented in general-use digital computers that execute the programs using a computer-readable recording medium. Also, structures of data used in the above-described method may be recorded on computer-readable recording media by using various media. Examples of the computer-readable recording medium include magnetic storage media (e.g., ROM, RAM, USB, floppy disks, hard disks, etc.), optical recording media (e.g., CD-ROMs or DVDs), etc.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating system comprising:

an aerosol generating device comprising a first vaporizer configured to generate a first aerosol by heating a first liquid composition, a second vaporizer configured to generate a second aerosol by heating a second liquid composition, and a controller configured to control the first vaporizer and the second vaporizer; and an aerosol generating article accommodated in the aerosol generating device and indirectly heated by heat generated by the first vaporizer and the second vaporizer, wherein the controller is configured to control power supplied to the first vaporizer and the second vaporizer, based on a first mode, in which a smokeless aerosol is generated, and a second mode, in which a transport amount of nicotine included in the aerosol generating article is adjusted, wherein the first vaporizer comprises a first hollow portion, wherein the second vaporizer comprises a second hollow portion, wherein the first vaporizer and the second vaporizer are detachably coupled to each other, and wherein, in a state in which the first vaporizer and the second vaporizer are coupled, the first hollow portion and the second hollow portion form a hollow into which the aerosol generating article is inserted.

2. The aerosol generating system of claim 1, wherein the first vaporizer comprises a first liquid storage storing the first liquid composition, the second vaporizer comprises a second liquid storage storing the second liquid composition, and the first liquid storage and the second liquid storage are divided by a partition.

3. The aerosol generating system of claim 1, wherein the first vaporizer and the second vaporizer are arranged to allow at least one of the first aerosol and the second aerosol to pass through the aerosol generating article.

4. The aerosol generating system of claim 1, wherein the first liquid composition comprises a first moisturizer, and the first moisturizer comprises a mixture in which vegetable glycerin and propylene glycol are mixed at a certain ratio.

5. The aerosol generating system of claim 4, wherein a ratio of the vegetable glycerin to the propylene glycol in the first moisturizer is between about 4:1 and about 9:1.

6. The aerosol generating system of claim 1, wherein the second liquid composition comprises a second moisturizer, and the second moisturizer only comprises propylene glycol.

7. The aerosol generating system of claim 1, wherein the aerosol generating article comprises a tobacco medium container and a filter.

8. The aerosol generating system of claim 7, wherein the nicotine is contained in the tobacco medium container.

9. The aerosol generating system of claim 7, wherein the aerosol generating article further comprises a heat-conducting wrapper surrounding the tobacco medium container and configured to deliver, to the tobacco medium container, heat generated by the first vaporizer and the second vaporizer.

10. The aerosol generating system of claim 1, wherein the first vaporizer and the second vaporizer are configured to indirectly heat the aerosol generating article by heating the hollow.

11. The aerosol generating system of claim 10, wherein the first vaporizer and the second vaporizer are configured to indirectly heat the aerosol generating article at a temperature ranging from about 150 degrees Celsius to about 250 degrees Celsius.

12. The aerosol generating system of claim 1, wherein the controller is configured to, in the first mode, supply power only to the second vaporizer.

13. The aerosol generating system of claim 1, wherein the controller is configured to, in the second mode, selectively supply power to the second vaporizer while supplying power to the first vaporizer.

14. The aerosol generating system of claim 1, wherein the aerosol generating device further comprises a communication unit configured to communicate with an external device, the communication unit is configured to receive a remote control signal from the external device, and the controller is configured to control power supplied to the first vaporizer and the second vaporizer, based on the remote control signal.

* * * * *